US009777247B2

(12) United States Patent
Adams

(10) Patent No.: US 9,777,247 B2
(45) Date of Patent: Oct. 3, 2017

(54) AUTOMOTIVE CLEANING SOLUTION

(71) Applicant: Roosevelt Adams, Orlando, FL (US)

(72) Inventor: Roosevelt Adams, Orlando, FL (US)

( * ) Notice: Subject to any disclaimer, the term of this patent is extended or adjusted under 35 U.S.C. 154(b) by 68 days.

(21) Appl. No.: 15/066,215

(22) Filed: Mar. 10, 2016

(65) Prior Publication Data

US 2016/0264914 A1 Sep. 15, 2016

Related U.S. Application Data

(60) Provisional application No. 62/130,774, filed on Mar. 10, 2015.

(51) Int. Cl.

| | |
|---|---|
| ***C11D 3/18*** | (2006.01) |
| ***C11D 3/20*** | (2006.01) |
| ***C11D 1/72*** | (2006.01) |
| ***C11D 3/43*** | (2006.01) |

(52) U.S. Cl.

CPC ..... *C11D 3/187* (2013.01); *C11D 1/72* (2013.01); *C11D 3/2068* (2013.01); *C11D 3/43* (2013.01)

(58) Field of Classification Search

CPC ..... C11D 3/43

See application file for complete search history.

(56) References Cited

U.S. PATENT DOCUMENTS

| | | | | |
|---|---|---|---|---|
| 4,999,126 | A * | 3/1991 | Meade | C09D 9/00 134/38 |
| 5,013,485 | A | 5/1991 | Tsukuda et al. | |
| 5,538,662 | A * | 7/1996 | Klier | C11D 3/43 510/284 |
| 6,767,878 | B1 | 7/2004 | Paye et al. | |
| 8,927,482 | B1 | 1/2015 | Patterson | |
| 2004/0121927 | A1* | 6/2004 | McDonald | C11D 7/26 510/245 |
| 2006/0089281 | A1* | 4/2006 | Gibson | C09D 9/005 510/201 |
| 2010/0154146 | A1* | 6/2010 | Shah | B41M 7/00 8/552 |
| 2011/0281781 | A1* | 11/2011 | Wilson | B01F 17/0021 510/206 |
| 2012/0040880 | A1* | 2/2012 | Rieth | A61K 8/39 510/138 |

* cited by examiner

*Primary Examiner* — Gregory Webb

(74) *Attorney, Agent, or Firm* — Matthew G. McKinney, Esq.; Allen, Dyer et al.

(57) ABSTRACT

An automotive cleaning composition includes by weight of the composition about 48% by weight of xylene, about 22% by weight of a nonylphenol ethoxylate, about 15% by weight of a hydrophobic glycol ether, and the balance being water.

4 Claims, No Drawings

AUTOMOTIVE CLEANING SOLUTION

RELATED APPLICATIONS

This application claims priority to U.S. Provisional Patent Application No. 62/130,774 filed Mar. 10, 2015, which is incorporated herein by reference.

FIELD

The present disclosure is generally related to an automotive cleaning composition.

BACKGROUND

Automotive finishes often suffer from the deteriorative effects of surface oxidation of the paint from sunlight, crazing from cracks in the color coat, discoloration from contaminants and water spotting. Cleaning products for automotive finishes are intended to remove road grime and oxidized paint without stripping off or otherwise adversely affecting the finish.

Automotive finishes typically include a base coat containing color pigments or metal flake and a clear acrylic top coat. A polish cleans and shines the finish on an automobile surface in a single step to combine the advantages of cleaners and polishes that require two application steps. A cleaner usually contains fine abrasives intended to remove road dirt, insects, tree sap, etc., where a polish typically contains milder abrasives for removing stains and scuff marks. A shortcoming of the existing cleaners and polishes is that the clear top coat finish can be scratched, dulled, and removed by cleaners and polishes that contain abrasives.

Automotive polishes may be either solvent-based or aqueous emulsions in solid, semi-solid or liquid form and generally contain abrasives, hydrocarbon solvents, waxes, silicones, and water. The polishes generally contain about 1-3 percent silicone polymers, which improve wax film lubricity and gloss, and to provide a hydrophobic coating on the automobile finish. Other polishes may contain as much as about 4-7 percent silicone polymers in place of waxes to provide a finish having durability and increased resistance to detergents. Abrasives that are used include diatomaceous earths, amorphous silicas, aluminum silicates, and clays, for example. In order to effectively clean and polish large surfaces, an abrasive must be used having an average particle size of about 0.1 to about 7 microns, which may scratch the finishes on automobiles.

Accordingly, there is a need in the art for an exterior cleaning composition that has the characteristic and performance of an abrasive cleaner and polish, but is non-scratching for modern automotive finishes. In addition, there is a need for an interior cleaning composition that is effective to polish plastic moldings and also that can remove stain and spills while having a pleasing aroma.

SUMMARY

A automotive cleaning composition is disclosed. The composition includes an aromatic hydrocarbon such as xylene, a nonionic surfactant such as nonylphenol ethoxylate, a hydrophobic glycol ether having high solvency and coupling abilities, and water. The present composition can be used to clean and polish painted surfaces, such as surfaces provided by automobiles, bicycles, snowmobiles, motorcycles, boats and the like.

In a particular illustrative embodiment, the exterior cleaning composition comprises by weight:

(a) about 48% by weight of xylene;
(b) about 22% by weight of a nonylphenol ethoxylate;
(c) about 15% by weight of a hydrophobic glycol ether; and
(d) the balance being water.

A particular advantage of the composition is that the composition can provide a polished finish, normally attainable only by cleaners and polishes containing abrasives of relatively larger particulate size and can do so without scratching the metal surface. A particular benefit of the present composition is that it provides a premium rub-to-polish type product of exceptionally good performance in regard to the speed and smoothness of the application as well as the gloss and durability of the resultant finish.

Yet another benefit of the present invention is that the heavy rubbing usually associated with achieving a durable shine on polishing a metal substrate, particularly an automobile surface, is not required. Only a thin coat of the composition need be applied and then wiped away to obtain a high-gloss, detergent-resistant finish providing still another economic benefit.

In addition, an interior or molding cleaning composition is disclosed. It can be used to clean and polish hard non-metal surfaces on which a durable polished shine is desired, but which may be scratched by conventional abrasives, for example, fiberglass structures, polycarbonate and acrylic plastic typically provided by the body exteriors and interiors of automobiles, boats, sport vehicles and the like.

In a particular illustrative embodiment, the interior cleaning composition comprises in the total composition:

(a) less than 4% by weight of methyl ether;
(b) about 2 to about 40% by weight of a nonylphenol ethoxylate;
(c) about 13 to about 38% by weight of a hydrophobic glycol ether; and
(d) the balance being water.

Still further benefits and advantages of the present invention will be apparent to those skilled in the art from the detailed description and examples that follow.

DETAILED DESCRIPTION

A cleaning composition of one illustrative embodiment disclosed herein may be applied to the painted surface of an automobile that may be coated with acrylic or enamel. The composition can clean and provide a shiny finish on metallic surfaces in a single step and leave behind a thin film over the surface that provides a luster.

The composition is a sprayable liquid, where the total composition by weight is about 48% by weight of xylene, about 22% by weight of a nonylphenol ethoxylate, about 15% by weight of a hydrophobic glycol ether, and the balance being water. In a particular embodiment, the nonylphenol ethoxylate is water soluble and comprises a 9.5 mole ethoxylate of nonylphenol. In another particular embodiment, the hydrophobic glycol ether comprises propylene glycol n-butyl ether.

The composition described herein may be compounded by techniques well known in the polishing art. The composition may also include ingredients known in the polishing art, as used for their commonly employed purpose.

The composition is utilized by spraying a small amount of about 1 to about 3 grams on the surface. The product is applied in a thin layer onto the surface to be cleaned and polished by spreading the applied amount with the applicator using a circular overlapping stroking motion to provide a substantially clear relatively thin coating thereon. The surface should first be clean and dry prior to the application of the composition.

The applied composition is allowed to dry on the surface under ambient atmospheric temperature and humidity conditions for a period of time. The surface is then wiped with a soft cloth and without heavy rubbing pressure. The foregoing steps are repeated over each area until the entire surface is substantially cleaned and polished to a durable, detergent-resistant high gloss finish leaving a thin film behind.

As used herein, the word "wiping" in its various grammatical forms is meant to indicate removal of the applied thin coat of cleaner/polish composition without substantial heavy pressure being exerted against the substrate to be cleaned and polished. The word "rubbing" in its various grammatical forms is used herein to indicate the exertion of a substantial pressure against the substrate to be polished normally associated with the removal of excess cleaner/polish composition and the achieving of high gloss when using conventional paste and emulsion polishes.

An interior cleaning composition can be used to clean and remove stains from carpet, plastic moldings, and other non-metallic surfaces. The interior cleaning composition may also be a sprayable liquid where the total composition by weight is less than 4% by weight of methyl ether, about 2 to about 40% by weight of a nonylphenol ethoxylate, about 13 to about 38% by weight of a hydrophobic glycol ether, and the balance being water.

As used herein, effective amounts are generally those amounts listed as the ranges or levels of ingredients in the descriptions. Unless otherwise stated, amounts listed in percentage ("%'s") are in weight percent of the total composition.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule.

These configurations include, but are not limited to isotactic, syndiotactic and random symmetries.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, cationic, nonionic, zwitterionic and/or amphoteric agents.

As described above, the composition may be sprayed directly onto the target surface and therefore may be packaged in a spray dispenser. The spray dispenser may be any of the manually activated means for producing a spray of liquid droplets as is known in the art, e.g. trigger-type, pump-type, electrical spray, hydraulic nozzle, sonic nebulizer, high pressure fog nozzle, non-aerosol self-pressurized, and aerosol-type spray means. Automatic activated means may also be used herein. These types of automatic means are similar to manually activated means with the exception that the propellant is replaced by a compressor.

The spray dispenser may be an aerosol dispenser. The aerosol dispenser comprises a container which can be constructed of any of the conventional materials employed in fabricating aerosol containers. The aerosol dispenser utilizes a pressurized sealed container from which the inventive composition is dispensed through an actuator/valve assembly under pressure. The aerosol dispenser is pressurized by incorporating therein a gaseous component generally known as a propellant.

In another illustrative embodiment, the spray dispenser may be a non-aerosol, manually activated, pump-spray dispenser. The pump-spray dispenser includes a container and a pump mechanism which securely screws or snaps onto the container. The pump mechanism includes a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof. The container and the pump mechanism can be constructed of any conventional material employed in fabricating pump-spray dispensers.

In yet another illustrative embodiment, the spray dispenser may be a manually activated trigger-spray dispenser. The trigger-spray dispenser includes a container and a trigger both of which can be constructed of any of the conventional material employed in fabricating trigger-spray dispensers. The trigger-spray dispenser does not incorporate a propellant gas. Instead, the trigger-spray dispenser acts upon a discrete amount of the composition itself by means of a piston or a collapsing bellows that displaces the composition through a nozzle to create a stream or spray of liquid.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

That which is claimed is:

1. An automotive exterior cleaning composition comprising by weight:

(a) about 48% by weight of xylene;

(b) about 22% by weight of nonylphenol ethoxylate;

(c) about 15% by weight of hydrophobic glycol ether; and (d) the balance being water.

2. The automotive exterior cleaning composition of claim 1, wherein the nonylphenol ethoxylate comprises a 9.5 mole ethoxylate of nonylphenol.

3. The automotive exterior cleaning composition of claim 2, wherein the hydrophobic glycol ether comprises propylene glycol n-butyl ether.

4. The automotive exterior cleaning composition of claim 1, wherein the nonylphenol ethoxylate is water soluble.

* * * * *